US008313623B2

(12) United States Patent
Antozzi et al.

(10) Patent No.: US 8,313,623 B2
(45) Date of Patent: Nov. 20, 2012

(54) CATHODE FOR ELECTROLYTIC PROCESSES

(75) Inventors: Antonio Lorenzo Antozzi, Merate (IT); Alice Calderara, Milan (IT); Marianna Brichese, Caorle (IT)

(73) Assignee: Industrie de Nora S.p.A., Milan (IT)

( * ) Notice: Subject to any disclaimer, the term of this patent is extended or adjusted under 35 U.S.C. 154(b) by 0 days.

(21) Appl. No.: 13/440,292

(22) Filed: Apr. 5, 2012

(65) Prior Publication Data

US 2012/0199473 A1 Aug. 9, 2012

Related U.S. Application Data

(63) Continuation of application No. PCT/EP2010/064964, filed on Oct. 7, 2010.

(30) Foreign Application Priority Data

Oct. 8, 2009 (IT) ..... MI2009A1719

(51) Int. Cl.
*C25B 11/06* (2006.01)
*C25B 11/08* (2006.01)

(52) U.S. Cl. ..... 204/290.1; 204/290.14; 204/252; 427/528; 427/125; 427/226; 427/229; 427/252; 427/327; 427/328; 427/331; 427/372.2; 427/376.8

(58) Field of Classification Search ..... 204/290.1, 204/290.14, 252; 427/528, 77, 125, 226, 427/229, 252, 327, 328, 331, 372.2, 376.8; 205/149, 152, 170, 220, 224, 227
See application file for complete search history.

(56) References Cited

U.S. PATENT DOCUMENTS

| | | | | |
|---|---|---|---|---|
| 4,133,730 | A * | 1/1979 | Du Bois et al. | 205/511 |
| 4,545,883 | A * | 10/1985 | Ovshinsky et al. | 204/192.15 |
| 5,324,395 | A * | 6/1994 | Paul et al. | 205/630 |
| 5,492,732 | A * | 2/1996 | Paul et al. | 427/453 |
| 5,622,613 | A | 4/1997 | Arimoto | |
| 7,943,020 | B2 * | 5/2011 | Antozzi et al. | 204/290.14 |
| 2009/0194411 | A1 * | 8/2009 | Antozzi et al. | 204/290.14 |
| 2011/0209992 | A1 * | 9/2011 | Urgeghe et al. | 204/263 |

FOREIGN PATENT DOCUMENTS

WO 2008043766 A2 4/2008

OTHER PUBLICATIONS

International Search Report for PCT/EP2010/064964 dated Dec. 28, 2010.

* cited by examiner

*Primary Examiner* — Bruce Bell
(74) *Attorney, Agent, or Firm* — Eschweiller & Associates, LLC

(57) ABSTRACT

A cathode for electrolytic processes, particularly suitable for hydrogen evolution in chlor-alkali electrolysis comprises a metal substrate provided with a catalytic coating made of two layers containing palladium, rare earths (such as praseodymium) and a noble component selected between platinum and ruthenium. The rare earth percent amount by weight is lower in the outer layer than in the inner layer.

9 Claims, No Drawings

CATHODE FOR ELECTROLYTIC PROCESSES

CROSS-REFERENCE TO RELATED APPLICATION

This application is a continuation of PCT/EP2010/064964 filed Oct. 7, 2010, that claims the benefit of the priority date of Italian Patent Application No. MI2009A001719 filed Oct. 8, 2009, the contents of which are herein incorporated by reference in their entirety.

FIELD OF THE INVENTION

The invention relates to an electrode for use in electrolytic processes and to a method of manufacturing thereof.

BACKGROUND

The invention relates to a cathode for electrolytic processes, in particular to a cathode suitable for hydrogen evolution in an industrial electrolytic process. In the following, reference will be made to chlor-alkali electrolysis as a typical process of industrial electrolysis with cathodic hydrogen evolution, but the invention is not limited to a particular application.

In the industry of electrolytic processes, competitiveness is associated with several factors, the main of which is the reduction of energy consumption, directly correlated with the operative voltage. This justifies the many efforts directed to reduce the various components of the latter, for instance ohmic drops, which depend on process parameters such as temperature, electrolyte concentration and interelectrodic gap, besides anodic and cathodic overvoltage. For this reason, although some chemically resistant metallic materials deprived of catalytic activity—such as for instance carbon steels—may be used as hydrogen-evolving cathodes in various electrolytic processes, the use of electrodes activated with a catalytic coating has become more widespread with the purpose of decreasing the hydrogen cathodic overvoltage. Good results can thus be obtained by using metal substrates, for instance made of nickel, copper or steel, provided with ruthenium oxide or platinum-based catalytic coatings. Energy savings obtainable through the use of activated cathodes, in fact can sometimes compensate for the costs derived from the employment of precious metal-based catalysts. At any rate, the economic convenience of the use of activated cathodes basically depends on their operative lifetime. In order to compensate for the cost of installation of activated cathodic structures in a chlor-alkali cell, it is for instance necessary to guarantee their functioning for a period of time not lower than 2 or 3 years. Nevertheless, the vast majority of noble metal-based catalytic coatings suffer great damages following the occasional current reversals which can typically occur in case of malfunctioning of industrial plants: the passage of anodic current, even of limited duration, leads to a shifting of the potential to very high values, somehow giving rise to the dissolution of platinum or of ruthenium oxide. A partial solution of this problem was proposed in international patent application WO 2008/043766 incorporated herein in its entirety, disclosing a cathode obtained on a nickel substrate provided with a coating consisting of two distinct zones, one of which comprises palladium and optionally silver, with a protective function especially towards current reversal phenomena, and an activation zone comprising platinum and/or ruthenium, preferably mixed with a small content of rhodium, with a function of catalyst for cathodic hydrogen evolution. The increase in the tolerance to current reversal phenomena is presumably attributable to the role of palladium, which can form hydrides during the normal cathodic operation. During the reversals, hydrides would be ionised preventing the electrode potential from shifting to dangerous levels. Although the invention disclosed in WO 2008/043766 proves useful in extending the lifetime of activated cathodes in electrolysis processes, suitable performances are provided only by those formulations containing a significant amount of rhodium. In consideration of the very high price of rhodium and of the limited availability of this metal, this appears to be a strong limitation to the use of such kind of coatings.

There exists a need, then, for a new cathode composition for industrial electrolytic processes, in particular for electrolytic processes with cathodic evolution of hydrogen, characterised by a higher catalytic activity and by an equivalent or higher duration and tolerance to accidental current reversals in the usual operating conditions with respect to prior art formulations.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter. As provided herein, the invention comprises, under one aspect a cathode for electrolytic processes comprising a metal substrate provided with a multilayer catalytic coating comprising at least one internal catalytic layer and one external catalytic layer, both the internal and the external catalytic layers containing palladium, at least one rare earth and at least one noble component comprising platinum and ruthenium, wherein the external catalytic layer has a rare earth content of 10 to 45% by weight and the internal catalytic layer has a rare earth content higher than that of the external catalytic layer.

In another aspect, the invention comprises a Method for the manufacturing of a cathode comprising providing a metal substrate, applying a multilayer catalyting coating comprising at least one internal catalytic layer and at least one external catalytic layer by thermally decomposing a multicoat of a first precursor solution containing at least one salt of Pd, at least one salt of a rare earth metal and at least one salt of a noble metal selected between Pt and Ru, and thermally decomposing a multicoat of a second precursor solution containing at least one salt of Pd, at least one salt of a rare earth metal and at least one salt of a noble metal selected between Pt and Ru, wherein the second precursor solution has a percentage content of rare earth metal with respect to the overall sum of metals lower than the percentage content of rare earth metal in the first precursor solution.

To the accomplishment of the foregoing and related ends, the following description sets forth certain illustrative aspects and implementations. These are indicative of but a few of the various ways in which one or more aspects may be employed. Other aspects, advantages, and novel features of the disclosure will become apparent from the following detailed description.

DESCRIPTION

Various aspects of the invention are set out in the accompanying claims.

In one embodiment, a cathode for electrolytic processes consists of a metal substrate, for instance made of nickel, copper or carbon steel, provided with a catalytic coating comprising at least two layers, both containing palladium, rare earths and at least one component selected between platinum and ruthenium, wherein the percent amount of rare earths is higher in the inner layer—indicatively above 45% by weight—and lower in the outer layer, indicatively 10 to 45% by weight. In one embodiment, the percent amount of rare earth is 45 to 55% by weight in the inner catalytic layer and 30 to 40% by weight in the outer catalytic layer. In the description and in the claims of the instant application, the percent amount by weight of the various elements is referred to the metals, except when specified otherwise. The indicated elements may be present as such or in form of oxides or other compounds, for instance platinum and ruthenium may be present in form of metals or oxides, rare earths mainly as oxides, palladium mainly as oxide upon manufacturing the electrode and mainly as metal in operating conditions under hydrogen evolution. Inventors have surprisingly observed that the amount of rare earths inside the catalytic layer displays its protective action versus the noble component more effectively when a certain compositional gradient is established, in particular when the rare earth content is lower in the outermost layer. Without wishing the invention to be bound to a particular theory, it might be assumed that the reduced amount of rare earth in the outer layer makes the platinum or ruthenium catalytic sites more accessible to the electrolyte, without significantly altering the overall structure of the coating. In one embodiment, rare earths comprise praseodymium, even though the inventors found out how other elements of the same group, for instance cerium and lanthanum, are capable of displaying an analogous action with similar results. In one embodiment, the catalytic coating is free of rhodium. The catalytic coating formulation with a reduced amount of rare earths in the outermost layer is characterised by an extremely low hydrogen evolution cathodic overvoltage, so that the use of rhodium as catalyst becomes unnecessary. This can have the advantage of reducing the manufacturing cost of the electrode to a remarkable extent, given the tendency of the price of rhodium to remain consistently higher than those of platinum and ruthenium. In one embodiment, the palladium to noble component weight ratio is 0.5 to 2 referred to the metals. This can have the advantage of providing an adequate catalytic activity combined with a suitable protection of the catalyst from accidental current reversal phenomena. In one embodiment, the palladium content in such formulation can be partially replaced by silver, for instance with an Ag/Pd molar ratio of 0.15 to 0.25. This can have the advantage of improving the capability of palladium of absorbing hydrogen during operation and oxidising the absorbed hydrogen during the accidental current reversals.

In one embodiment, the above described electrode is obtained by oxidative pyrolysis of precursor solutions, that is by thermal decomposition of at least two solutions sequentially applied. Both solutions comprise salts or other soluble compounds of palladium, of a rare earth such as praseodymium and of at least one noble metal such as platinum or ruthenium, under the condition that the last applied solution, directed to form the outermost catalytic layer, have a rare earth percent amount lower than that of the first applied solution. In one embodiment, the salts contained in the precursor solutions are nitrates and their thermal decomposition is carried out at a temperature of 430-500° C. in the presence of air.

Some of the most significant results obtained by the inventors are presented in the following examples, which shall not be intended as a limitation of the extent of the invention.

Example 1

A nickel 200 mesh of 100 mm×100 mm×0.89 mm size was subjected to a blasting treatment with corundum, then etched in 20% boiling HCl for 5 minutes. The mesh was then painted with 5 coats of an aqueous solution of Pt (II) diamino dinitrate (30 g/l), Pr (III) nitrate (50 g/l) and Pd (II) nitrate (20 g/l) acidified with nitric acid, with execution of a 15 minute thermal treatment at 450° C. after each coat until obtaining the deposition of 1.90 g/m$^2$ of Pt, 1.24 g/m$^2$ of Pd and 3.17 g/m$^2$ of Pr (inner catalytic layer formation). On the thus obtained catalytic layer, 4 coats of a second solution were applied containing Pt (II) diamino dinitrate (30 g/l), Pr (III) nitrate (27 g/l) and Pd (II) nitrate (20 g/l) acidified with nitric acid, with execution of a 15 minute thermal treatment at 450° C. after each coat until obtaining the deposition of 1.77 g/m$^2$ of Pt, 1.18 g/m$^2$ of Pd and 1.59 g/m$^2$ of Pr (outer catalytic layer formation).

The sample was subjected to an operating test, displaying an ohmic-corrected initial average cathodic potential of −924 mV/NHE at 3 kA/m$^2$ under hydrogen evolution in 33% NaOH, at a temperature of 90° C., corresponding to an excellent catalytic activity.

The same sample was subsequently subjected to cyclic voltammetry in the range from −1 to +0.5 V/NHE at a scan rate of 10 mV/s; the average cathodic potential variation after 25 cycles was 15 mV, corresponding to an excellent tolerance to current reversal.

Example 2

A nickel 200 mesh of 100 mm×100 mm×0.89 mm size was subjected to a blasting treatment with corundum, then etched in 20% boiling HCl for 5 minutes. The mesh was then painted with 3 coats of an aqueous solution of Pt (II) diamino dinitrate (30 g/l), Pr (III) nitrate (50 g/l) and Pd (II) nitrate (20 g/l) acidified with nitric acid, with execution of a 15 minute thermal treatment at 460° C. after each coat until obtaining the deposition of 1.14 g/m$^2$ of Pt, 0.76 g/m$^2$ of Pd and 1.90 g/m$^2$ of Pr (inner catalytic layer formation). On the thus obtained catalytic layer, 6 coats of a second solution were applied containing Pt (II) diamino dinitrate (23.4 g/l), Pr (III) nitrate (27 g/l) and Pd (II) nitrate (20 g/l) acidified with nitric acid, with execution of a 15 minute thermal treatment at 460° C. after each coat until obtaining the deposition of 1.74 g/m$^2$ of Pt, 1.49 g/m$^2$ of Pd and 2.01 g/m$^2$ of Pr (outer catalytic layer formation).

The sample was subjected to an operating test, displaying an ohmic-corrected initial average cathodic potential of −926 mV/NHE at 3 kA/m$^2$ under hydrogen evolution in 33% NaOH, at a temperature of 90° C., corresponding to an excellent catalytic activity.

The same sample was subsequently subjected to cyclic voltammetry in the range from −1 to +0.5 V/NHE at a scan rate of 10 mV/s; the average cathodic potential variation after 25 cycles was 28 mV, corresponding to a still acceptable tolerance to current reversal albeit a bit lower than the electrode of example 1; this was attributed to the fact that the percent amount of rare earth in the inner catalytic layer (65%) is a little higher than the value later identified as optimum (45-55%).

Example 3

A nickel 200 mesh of 100 mm×100 mm×0.89 mm size was subjected to a blasting treatment with corundum, then etched in 20% boiling HCl for 5 minutes. The mesh was then painted with 5 coats of an aqueous solution of Ru (III) nitrosyl nitrate (30 g/l), Pr (III) nitrate (50 g/l), Pd (II) nitrate (16 g/l) and $AgNO_3$ (4 g/l) acidified with nitric acid, with execution of a 15 minute thermal treatment at 430° C. after each coat until obtaining the deposition of 1.90 g/m$^2$ of Ru, 1.01 g/m$^2$ of Pd, 0.25 g/m$^2$ of Ag and 3.17 g/m$^2$ of Pr (inner catalytic layer formation). On the thus obtained catalytic layer, 6 coats of a second solution were applied containing Ru (III) nitrosyl nitrate (30 g/l), Pr (III) nitrate (27 g/l), Pd (II) nitrate (16 g/l) and $AgNO_3$ (4 g/l) acidified with nitric acid, with execution of a 15 minute thermal treatment at 430° C. after each coat until obtaining the deposition of 2.28 g/m$^2$ of Ru, 1.22 g/m$^2$ of Pd, 0.30 g/m$^2$ of Ag and 2.05 g/m$^2$ of Pr (outer catalytic layer formation).

The sample was subjected to an operating test, displaying an ohmic-corrected initial average cathodic potential of −925 mV/NHE at 3 kA/m$^2$ under hydrogen evolution in 33% NaOH, at a temperature of 90° C., corresponding to an excellent catalytic activity.

The same sample was subsequently subjected to cyclic voltammetry in the range from −1 to +0.5 V/NHE at a scan rate of 10 mV/s; the average cathodic potential variation after 25 cycles was 12 mV, corresponding to an excellent tolerance to current reversal.

Example 4

A nickel 200 mesh of 100 mm×100 mm×0.89 mm size was subjected to a blasting treatment with corundum, then etched in 20% boiling HCl for 5 minutes. The mesh was then painted with 5 coats of an aqueous solution of Pt (II) diamino dinitrate 30 g/l), La (III) nitrate (50 g/l) and Pd (II) nitrate (20 g/l) acidified with nitric acid, with execution of a 15 minute thermal treatment at 450° C. after each coat until obtaining the deposition of 1.90 g/m$^2$ of Pt, 1.24 g/m$^2$ of Pd and 3.17 g/m$^2$ of La (inner catalytic layer formation). On the thus obtained catalytic layer, 3 coats of a second solution were applied containing Pt (II) diamino dinitrate (30 g/l), La (III) nitrate (32 g/l) and Pd (II) nitrate (20 g/l) acidified with nitric acid, with execution of a 15 minute thermal treatment at 450° C. after each coat until obtaining the deposition of 1.14 g/m$^2$ of Pt, 0.76 g/m$^2$ of Pd and 1.22 g/m$^2$ of La (outer catalytic layer formation).

The sample was subjected to an operating test, displaying an ohmic-corrected initial average cathodic potential of −928 mV/NHE at 3 kA/m$^2$ under hydrogen evolution in 33% NaOH, at a temperature of 90° C., corresponding to an excellent catalytic activity.

The same sample was subsequently subjected to cyclic voltammetry in the range from −1 to +0.5 V/NHE at a scan rate of 10 mV/s; the average cathodic potential variation after 25 cycles was 22 mV, corresponding to an excellent tolerance to current reversal.

Counterexample 1

A nickel 200 mesh of 100 mm×100 mm×0.89 mm size was subjected to a blasting treatment with corundum, then etched in 20% boiling HCl for 5 minutes. The mesh was then painted with 7 coats of an aqueous solution of Pt (II) diamino dinitrate (30 g/l), Pr (III) nitrate (50 g/l), Rh (III) chloride (4 g/l) and Pd (II) nitrate (20 g/l) acidified with nitric acid, with execution of a 15 minute thermal treatment at 450° C. after each coat until obtaining the deposition of 2.66 g/m$^2$ of Pt, 1.77 g/m$^2$ of Pd, 0.44 g/m$^2$ of Rh and 4.43 g/m$^2$ of Pr (formation of a catalytic layer in accordance with WO 2008/043766).

The sample was subjected to an operating test, displaying an ohmic-corrected initial average cathodic potential of −930 mV/NHE at 3 kA/m$^2$ under hydrogen evolution in 33% NaOH, at a temperature of 90° C., corresponding to a good catalytic activity, albeit lower than that of the previous examples notwithstanding the presence of rhodium.

The same sample was subsequently subjected to cyclic voltammetry in the range from −1 to +0.5 V/NHE at a scan rate of 10 mV/s; the average cathodic potential variation after 25 cycles was 13 mV, corresponding to an excellent tolerance to current reversal.

Counterexample 2

A nickel 200 mesh of 100 mm×100 mm×0.89 mm size was subjected to a blasting treatment with corundum, then etched in 20% boiling HCl for 5 minutes. The mesh was then painted with 7 coats of an aqueous solution of Pt (II) diamino dinitrate (30 g/l), Pr (III) nitrate (50 g/l) and Pd (II) nitrate (20 g/l) acidified with nitric acid, with execution of a 15 minute thermal treatment at 460° C. after each coat until obtaining the deposition of 2.80 g/m$^2$ of Pt, 1.84 g/m$^2$ of Pd and 4.70 g/m$^2$ of Pr (catalytic layer formation).

The sample was subjected to an operating test, displaying an ohmic-corrected initial average cathodic potential of −936 mV/NHE at 3 kA/m$^2$ under hydrogen evolution in 33% NaOH, at a temperature of 90° C., corresponding to an average-to-good catalytic activity, lower than that of Counterexample 1 likely due to the absence of rhodium in the catalytic formulation.

The same sample was subsequently subjected to cyclic voltammetry in the range from −1 to +0.5 V/NHE at a scan rate of 10 mV/s; the average cathodic potential variation after 25 cycles was 80 mV, corresponding to a poor tolerance to current reversal.

Counterexample 3

A nickel 200 mesh of 100 mm×100 mm×0.89 mm size was subjected to a blasting treatment with corundum, then etched in 20% boiling HCl for 5 minutes. The mesh was then painted with 6 coats of an aqueous solution of Pt (II) diamino dinitrate (30 g/l), Pr (III) nitrate (28 g/l) and Pd (II) nitrate (20 g/l) acidified with nitric acid, with execution of a 15 minute thermal treatment at 480° C. after each coat until obtaining the deposition of 2.36 g/m$^2$ of Pt, 1.57 g/m$^2$ of Pd and 2.20 g/m$^2$ of Pr (catalytic layer formation).

The sample was subjected to an operating test, displaying an ohmic-corrected initial average cathodic potential of −937 mV/NHE at 3 kA/m$^2$ under hydrogen evolution in 33% NaOH, at a temperature of 90° C., corresponding to an average-to-good catalytic activity, as in Counterexample 2.

The same sample was subsequently subjected to cyclic voltammetry in the range from −1 to +0.5 V/NHE at a scan rate of 10 mV/s; the average cathodic potential variation after 25 cycles was 34 mV, corresponding to a tolerance to current reversal better than in Counterexample 2—most probably due to the different noble metal to rare earth ratio in the activation—but still unsatisfactory.

The previous description is not intended to limit the invention, which may be used according to different embodiments without departing from the scopes thereof, and whose extent is univocally defined by the appended claims.

Throughout the description and claims of the present application, the term "comprise" and variations thereof such as "comprising" and "comprises" are not intended to exclude the presence of other elements or additives.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention before the priority date of each claim of this application.

What we claim is:

1. Cathode for electrolytic processes comprising a metal substrate provided with a multilayer catalytic coating comprising at least one internal catalytic layer and one external catalytic layer, both the internal and the external catalytic layers containing palladium, at least one rare earth and at least one noble component comprising platinum and ruthenium, wherein the external catalytic layer has a rare earth content of 10 to 45% by weight and the internal catalytic layer has a rare earth content higher than that of the external catalytic layer.

2. The cathode according to claim 1, wherein the external catalytic layer has a rare earth content of 30 to 40% by weight and the internal catalytic layer has a rare earth content of 45 to 55% by weight.

3. The cathode according to claim 1, wherein the at least one rare earth is praseodymium.

4. The cathode according to claim 1, wherein the catalytic coating is rhodium-free.

5. The cathode according to claim 1, wherein the catalytic coating contains silver.

6. The cathode according to claim 5, wherein the weight ratio of the sum of palladium and silver to the noble component is 0.5 to 2 referred to the elements.

7. Cell for the electrolysis of an alkali chloride brine including at least one cathode according to claim 1.

8. Method for the manufacturing of a cathode comprising:

providing a metal substrate;

applying a multilayer catalyting coating comprising at least one internal catalytic layer and at least one external catalytic layer by thermally decomposing a multicoat of a first precursor solution containing at least one salt of Pd, at least one salt of a rare earth metal and at least one salt of a noble metal selected between Pt and Ru; and thermally decomposing a multicoat of a second precursor solution containing at least one salt of Pd, at least one salt of a rare earth metal and at least one salt of a noble metal selected between Pt and Ru, wherein the second precursor solution has a percentage content of rare earth metal with respect to the overall sum of metals lower than the percentage content of rare earth metal in the first precursor solution.

9. The method according to claim 8, wherein the salts of Pd, rare earth metal, Pt and Ru are nitrates and the thermal decomposition is carried out at a temperature of 430 to 500° C.

* * * * *